United States Patent [19]

Murphy

[11] 4,014,104

[45] Mar. 29, 1977

[54] DRYING OF LIGNITE USING NONAQUEOUS SOLVENTS

[75] Inventor: Charles L. Murphy, Smyrna, Ga.

[73] Assignee: Continental Oil Company, Ponca City, Okla.

[22] Filed: June 23, 1975

[21] Appl. No.: 589,096

[52] U.S. Cl. ..... 34/9

[51] Int. Cl.[2] ..... F26B 3/00

[58] Field of Search ..... 34/9

[56] References Cited

UNITED STATES PATENTS

| | | | |
|---|---|---|---|
| 3,327,402 | 6/1967 | Lamb et al. | 34/9 |
| 3,599,885 | 8/1971 | Alderman | 34/10 |
| 3,953,927 | 5/1976 | Hoffert | 34/9 |

*Primary Examiner*—John J. Camby
*Attorney, Agent, or Firm*—Richard W. Collins

[57] ABSTRACT

Drying of moist particulate carbonaceous material is facilitated by addition of a nonaqueous solvent having a low heat of vaporization and a low boiling point, such as methanol, to the material followed by application of heat to remove both solvent and water from the material.

4 Claims, 1 Drawing Figure

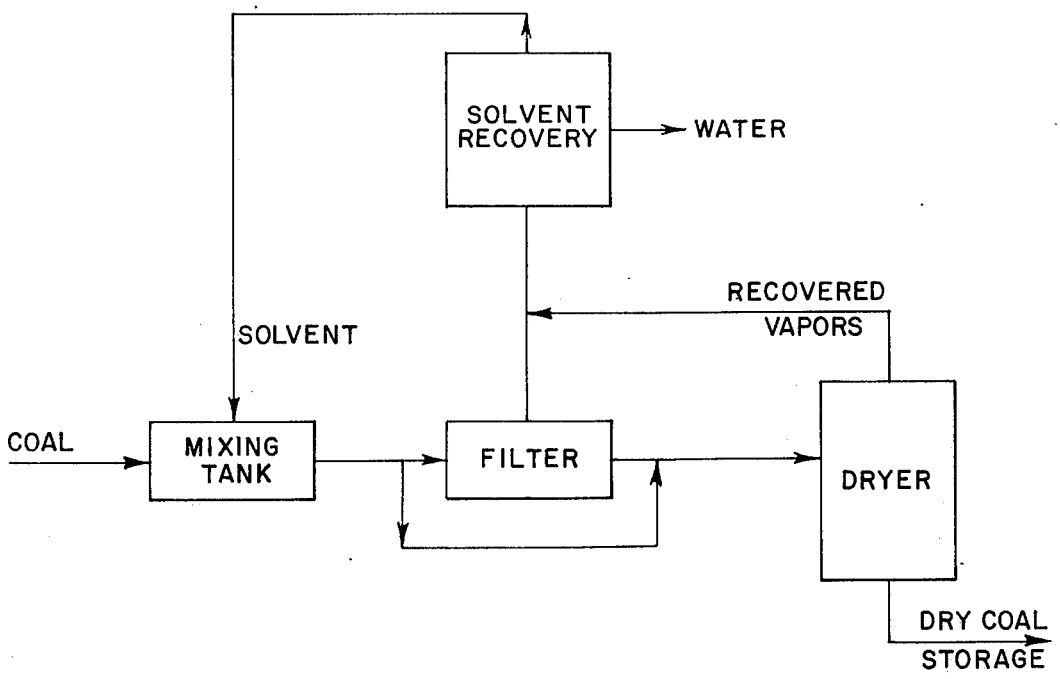
SOLVENT RECOVERY
WATER
RECOVERED VAPORS
SOLVENT
COAL
MIXING TANK
FILTER
DRYER
DRY COAL STORAGE

DRYING OF LIGNITE USING NONAQUEOUS SOLVENTS

BACKGROUND OF THE INVENTION

1. Field of the Invention

This invention relates to drying of particulate carbonaceous material such as coal, lignite, and the like. More particularly, this invention relates to a process for removing water from particulate carbonaceous material by a method which reduces the amount of heat required to obtain a given degree of dryness.

Raw coal as it comes from the mines is frequently subjected to a washing operation, resulting in coal particles having a high degree or surface moisture. This moisture leads to difficulties in handling and shipping, and various methods of dewatering coal have been utilized over the years.

Many lignite materials contain a very high amount of moisture. In some cases, the amount of so-called "inherent" moisture in lignite particles is as high as 65 percent by weight. At least part of this moisture must be removed in order to obtain efficient burning of the lignite and also to reduce the cost of transporting the material.

2. Description of the Prior Art

Several methods for dewatering coal have been practiced over the years. These include methods of mechanical drainage as well as filtration. Other methods used separately or in combination with mechanical water removal include fluid bed drying and other conventional drying techniques. The "Convertol" process in which a coal slurry is mixed with heavy oil and then passed through a centrifugal dryer has been widely used. U.S. Pat. Nos. 2,176,902; 3,381,388; and 3,520,067 are representative of patents describing these prior art processes.

In the drying of materials other than carbonaceous material, it has been proposed to remove water by utilizing a low boiling solvent such as methanol. U.S. Pat. No. 1,687,588 describes a method of drying corrodible materials by repeatedly washing the moist material with alcohol and then evaporating the alcohol from the surface of the particles. U.S. Pat. No. 3,374,550 describes a process for drying a sheet of paper as it is formed by passing the moist sheet through methanol to replace part of the water, followed by drying the sheet of paper in a conventional manner. It is stated that the energy required to obtain the desired degree of dryness is reduced in this manner, or the drying can take place at a lower temperature.

Prior to this invention, there has been no teaching of a method of reducing the moisture content of coal or lignite utilizing a solvent having a low heat of vaporization and low boiling point.

SUMMARY OF THE INVENTION

According to the process of the present invention, particulate carbonaceous material may be dried to be given degree of dryness in a shorter time, or at a lower temperature, or both, than with prior art processes for drying such material. Methanol or other low heat of vaporization solvent is mixed with the moist particulate carbonaceous material to replace part of the water, which may be surface moisture or interstitial moisture, or both, by the solvent which is vaporized more easily than water. The solvent may be mixed with the moist material by spraying it on the material or by passing the material through a tank containing the solvent or simply by covering the material with the solvent and then draining or filtering the solvent, containing part of the original moisture, from the material. The material is then subjected to a drying operation, and the desired degree of dryness is reached in a shorter time or at a lower drying temperature than if the solvent had not been used.

BRIEF DESCRIPTION OF THE DRAWING

The drawing is a flow diagram of the process of the invention.

DESCRIPTION OF THE PREFERRED EMBODIMENTS

The increasing use of wet processing methods in coal preparation plants and the increasing use of high moisture western coals and lignites have increased the need for an efficient process for removing enough of the moisture to enable efficient handling and shipping of the material. It is generally accepted that thermal drying is required to obtain a moisture content of 3 to 6 percent by weight for coal particles, where most of the moisture is surface moisture, or of 15 to 18 percent moisture for lignite particles, where most of the moisture is inherent moisture.

It is apparent that most of the surface moisture on coal particles could be removed by thorough washing with a solvent such as methanol, with the particles then being covered with methanol. What is not apparent is that many advantages are realized in addition to the reduced drying time and reduced drying temperature that are needed to remove methanol as compared to removing water from the surface of the particles. In addition to reduced cost involved in the smaller size dryer required to remove methanol, a more important saving is realized in that the stack gas cleaning equipment required is much smaller, and also the fines-containing gas, which must be removed, is not as hot, and therefrom is safer to handle. The obvious disadvantage to utilizing methanol in accordance with the invention is that a solvent recovery system must be provided. However, there are many situations where even though a solvent recovery system must be provided, the overall saving in capital cost and operating cost is considerable when the process of this invention is utilized.

While it is not normally necessary to reduce the moisture content of finely divided coal below about 3 percent, nevertheless even this degree of dryness is difficult to reach using conventional thermal drying techniques. Using the process of this invention, a moisture level of 3 percent is relatively easy to attain when the material being treated is finely divided coal in which the moisture is predominantly surface moisture. In accordance with the invention, coal particles from a water washing process or from a slurry transport system are processed by conventional means such as draining or filtering to remove all but the surface moisture, and the material is then mixed with methanol or other suitable solvent, dried to the desired degree of dryness in a reduced time or at a reduced temperature or with smaller equipment, and the solvent recovered by conventional technology for reuse in treating additional material.

An especially important embodiment of the invention involves reducing the moisture content of lignites prior to shipping the lignite over long distances. As mentioned earlier, some lignites as mined have as high as 65 percent by weight water incorporated therein as interstitial or inherent moisture. This moisture is not removed by filtration or draining. Lignites containing especially high amounts of water do not burn as efficiently as those containing less water, as would be expected. While not all lignites contain as much as 65 percent water, it is not uncommon for the moisture content to be within the range of 38 to 43 percent, which is still very high and contributes significantly to burning inefficiency and transportation cost if the moisture content is not reduced. On the other hand, it is not generally desired to dry lignite to less than 15 to 20 percent moisture, or the material will decrepitate and create excessive fine material, with resultant handling problems.

It has been demonstrated that approximately one-half of the inherent moisture in lignite can be replaced with methanol by a thorough washing of the lignite particles with methanol. Subsequent drying of the lignite particles containing water and methanol proceeds much more rapidly to an acceptable total moisture content. The methanol, which has replaced a portion of the inherent water, is removed much more readily than the remaining inherent water, such that the bulk of the methanol is recovered and the remaining moisture in the dried particles is mostly water.

To illustrate the improved results provided by this invention, a series of experiments was carried out. In these experiments, the results of which are shown in the following Examples 1 through 6, carbonaceous particulate material containing a given amount of moisture (either as water or water plus solvent) was placed in a tray resting on a top loading balance, and moisture removal was determined by measurement of change in weight of the tray and its contents with time. The contents were heated by two 250-watt infrared head lamps directed along the length of the tray. The intensity of the heat was regulated by means of a variable voltage supply. In each of the Examples 1 through 4, a western lignite which had been ground to -14 mesh was used.

EXAMPLE 1

355.0 grams of the lignite was placed under the heat lamps and dried. The initial moisture content (water) of the lignite was 29.0 percent by weight. The setting of the variable voltage supply was 80. The moisture content of the material was reduced to 7.7 percent after 7 hours.

EXAMPLE 2

442 grams of the same lignite as used in Example 1 was slurried in technical grade methanol and filtered. The initial total moisture content (water plus methanol) after filtering was 37.7 percent by weight. Using the same power setting and conditions as in Example 1, the material was dried to 7.8 percent total moisture (water plus methanol) in 3.7 hours. This illustrates that the drying time to obtain a given degree of dryness can be reduced by almost one-half utilizing this invention for this particular material.

EXAMPLE 3

494 grams of the lignite was slurried in crude methanol (84.3 percent methanol) and filtered as in Example 2. The filter cake to be dried contained 46.6 percent by weight total moisture (water plus methanol). After drying for 5.0 hours at the same conditions as in Examples 1 and 2, the moisture content had been reduced to 5.9 percent. Thus, even though the initial total moisture content of this filter cake was higher than the moisture content of the material in Example 1, in which methanol was not used, the cake was dried to a lower moisture content in a shorter time than was required in Example 1.

EXAMPLE 4

512 grams of the lignite was slurried in water and filtered. The filter cake contained 50.9 percent water. After drying for 9.5 hours with the setting of the variable voltage supply at 80, the filter cake contained 12.7 percent moisture. This shows that less moisture is removed from a lignite-water filter cake than from a lignite-water-methanol filter cake at comparable conditions as illustrated in Examples 2 and 3.

EXAMPLE 5

A coal-water slurry was filtered to a 50.0 percent moisture content. The cake was dried at a power setting on the variable power supply of 100. Under these conditions, the water-soaked coal dried to a moisture content of 9.1 percent in 3.0 hours.

EXAMPLE 6

The procedure of Example 5 was duplicated except that technical grade methanol was used in place of water. A moisture content of 9.1 percent was obtained in only 2.0 hours.

EXAMPLE 7

A -1 ½ + ½ inch fraction of lignite having an initial moisture (water) content of 38.6 percent by weight was washed with methanol. After 15 minutes washing, water amounting to 12 weight percent of the sample had been replaced by methanol. After 30 and 60 minutes, respectively, 14 and 19 weight percent had been replaced. The time required to dry a sample, which had been washed in methanol for 15 minutes, to 25 weight percent moisture (water plus methanol) in an induced draft at 160° C was 7.9 minutes, whereas a sample which had not been washed with methanol required 12.3 minutes to reach the same moisture level under identical drying conditions.

Tests indicated that lignite which had been methanol washed and then dried to 25 percent moisture had about the same degree of attrition as lignite that had not been methanol washed.

It is apparent that the process of this invention would not be practical for treating lignite where the total moisture content after drying was 25 percent or so if the proportion of methanol remaining after drying were as high as the proportion prior to drying, which as seen in Example 7 could be approximately one-half of the total moisture content in some cases. However, retention tests of determine the amount of methanol in lignite at 25 percent by weight total moisture (water plus methanol) showed that the amount of methanol remaining in lignite after drying to 25 weight percent total moisture was only about 2 percent. This amount could be reduced even further if necessary.

While methanol was the solvent utilized in all the Examples, it will be appreciated that other solvents having the requisite characteristics of (1) low heat of vaporization, defined herein as less than half the heat of vaporization of water; (2) miscibility with water; and (3) boiling point below 85° C, may be used. Preferred solvents which meet the foregoing criteria are lower molecular weight monohydric alcohols such as ethyl, isopropyl, and tertiary butyl alcohols. For practical reasons, methanol is the preferred solvent for the process of the invention.

The process of the invention, according to a preferred embodiment, is illustrated schematically in the drawing. As shown therein, wet coal and solvent are mixed in a mixing tank, and the mixture is transferred to a dryer, with an optional filtration step between the mixing tank and the dryer. Dried product is removed from the dryer, and vapors are taken overhead from the dryer, combined with filtrate from the filter if applicable, and passed to a solvent recovery step where water is separated from solvent. Recovered solvent is then returned to the mixing tank for reuse in the process. It will be appreciated that lignite could be substituted for coal, and that a draining step could be used in place of or in addition to the filtration step.

I claim:

1. A process for drying particulate lignite having an interstitial moisture content of at least 38 percent by weight comprising:

a. adding a nonaqueous solvent to said particulate lignite, said solvent having a heat of vaporization less than half that of water, a boiling point below 85° C, and being miscible with water, whereby a portion of said interstitial moisture is replaced by said solvent;

b. applying heat to said lignite to which said nonaqueous solvent has been added to vaporize water and solvent therefrom with the amount of solvent vaporized being proportionally greater than the amount of water vaporized whereby the ratio of solvent to water in the lignite is reduced by said heating; and c. recovering said solvent.

2. The process of claim 1 wherein heat is applied to said lignite to which said nonaqueous solvent has been added until the combined interstitial water and solvent content of said lignite is between 15 and 20 percent by weight.

3. The process of claim 1 wherein said lignite is washed with said solvent and filtered prior to application of heat thereto.

4. The process of claim 1 wherein said solvent is methanol.

* * * * *